United States Patent [19]

Marshall

[11] Patent Number: 4,934,706

[45] Date of Patent: Jun. 19, 1990

[54] COMBINATION LIE AND SHAFT POSITION INDICATOR

[76] Inventor: Perry C. Marshall, 103 Granada Ct., North, Plant City, Fla. 33566

[21] Appl. No.: 448,784

[22] Filed: Dec. 11, 1989

[51] Int. Cl.[5] ..... A63B 69/36; G01C 9/28; G01C 9/36

[52] U.S. Cl. ..... 273/183 D; 273/162 B; 273/32 H; 33/334; 33/389; 33/383

[58] Field of Search ..... 273/162 B, 183 D, 187 R, 273/32 B, 32 R, 77 R, 194 R, 32 H; 33/334, 370, 371, 372, 373, 262, 333, 389, 383

[56] References Cited

U.S. PATENT DOCUMENTS

| | | | |
|---|---|---|---|
| 2,677,184 | 5/1954 | Lindenbein | 33/334 X |
| 4,079,520 | 3/1978 | Davis | 33/334 |
| 4,141,151 | 2/1979 | Jansky | 33/334 |
| 4,211,415 | 7/1980 | Lindo | 273/162 B |
| 4,482,155 | 11/1984 | Higley | 273/162 B |

*Primary Examiner*—George J. Marlo

*Attorney, Agent, or Firm*—Joseph C. Mason; Ronald E. Smith

[57] ABSTRACT

A golf training aide is attached to a golf club shaft and visually indicates to the golfer when the club shaft is held in a vertical plane and when the club head is held in proper angular relation to the ground. An indication of vertical alignment of the shaft is given when a first bubble is centered in a first bubble tube member and an indication of proper club head position is given when a second bubble is centered in a second bubble tube member. In a first embodiment, the second bubble tube member is linear-in-configuration and is rotatable about a horizontal axis. In a second embodiment, the second bubble tube member is arcuate-in-configuration and has a fixed position.

8 Claims, 3 Drawing Sheets

COMBINATION LIE AND SHAFT POSITION INDICATOR

TECHNICAL FIELD

This invention relates, generally, to devices having utility as golf training aides. More particularly, it relates to a device that indicates whether or not a golfer is holding a club properly.

BACKGROUND ART

The lie angle of a club head is the angle between the center line of the hosel bore and the groundline at a point tangent to the center line of the club head base.

If the toe of a right-handed club head is tilted up at the moment the club head face impacts a ball, the face will be aimed to the left and the ball will thus travel to the left of its intended path of travel. Conversely, if the toe of a right-handed club head is tilted down, i.e., if the heel is tilted upwardly, the shot will go to the right.

The angle of the face of course determines the loft of the club head; the greater the loft, the more off the target line the face will be at impact if the club is not held at the proper lie angle. If a golfer uses a club having a shaft that is too long for that golfer, the golfer will tend to raise the toe of the club head and thereby make an off target shot. Conversely, if a club shaft is too short for the golfer, the heel of the club will be raised and an off target shot in the opposite direction will occur. Thus, every club in a golfer's bag should be of a length that allows the golfer to hold the club so that the line tangent to the sole of the club head is parallel to the groundline.

However, there are no satisfactory means for determining whether or not a particular club having a known lie angle is being held improperly by the golfer. Of course, bad shots will indicate an improper holding of the club, but no training or practice aids are known to exist that will teach the golfer how to hold the club properly.

Significantly, the art teaches a trial and error approach to the correction of a golfer's swing. A common technique is to have the golfer make repeated swings at a ball on a plywood surface; a mark is placed on the sole of the club head and after a swing has been completed the mark is examined for scuff marks in a effort to determine if the golfer was holding the toe or the heel of the club too high, and if so, by how much.

Thus, there is a need for a device that enables a golfer to determine when a club is being held properly, but the prior art neither teaches nor suggests how such a device could be supplied.

DISCLOSURE OF INVENTION

The present invention is disclosed in two illustrative embodiments. In both embodiments, a transversely disposed bubble tube of linear configuration is employed to indicate whether the golf club shaft is being held in a vertical plane. A second bubble tube having a longitudinal axis of symmetry is also provided in both embodiments. However, the longitudinally aligned bubble tube is linear in configuration and rotatably mounted in the first embodiment, whereas said second bubble tube is arcuate in configuration and fixedly mounted in the second embodiment.

In the first embodiment, the longitudinally aligned bubble tube is carried by an indicator member that is rotatably secured to a base member that in turn is secured by a clamp means to the shaft of the club at a preselected location along the extent thereof. Indicia means indicating differing lie angles are imprinted upon a vertically disposed side wall of the base member, and the indicator member is pivotally mounted and provided with a pointed end so that it can be aligned with a preselected indicia member.

Thus, to use the novel device, the indicator means is aligned with an indicia member that indicates the lie angle of the club head of the club being held, and the golfer holds the club so that the respective bubbles in both bubble tubes are centered. The centering of the transversely disposed bubble indicates that the shaft is being held in a vertical plane, and the centering of the longitudinally disposed bubble indicates that the club is being held in the proper angular position for its particular lie angle. The bubbles are interdependent, i.e., a failure to center one of them will produce a false reading in the other.

In the second embodiment, the elongate, longitudinally disposed, arcuate bubble tube is oriented so that it lies in coplanar relation to the club head, but said arcuate bubble tube is not rotatably adjustable.

Instead, indicia means indicating differing lie angles are positioned laterally adjacent the arcuate bubble tube along the extent thereof. Since each club head has a known lie angle, the golfer holds the club in a vertical plane by centering the transversely disposed bubble and then orients the club head properly in relation to the ground line by placing the bubble in the arcuate bubble tube adjacent to the indicia member indicating the lie angle of that club. For example, if the golfer is practicing with a 7 iron, the transversely disposed bubble is centered and then the club is moved in a vertical plane until the longitudinally disposed bubble is adjacent the indicia member for sixty-two degrees. Since the lie angle of a 7 iron is sixty-two degrees, when both bubbles are centered in their respective tubes, the club is being held properly by the golfer.

By holding the club with both bubbles centered, the golfer acquires muscular memory of the correct holding of that club, and with practice, this muscular memory will return to the golfer in game situations where the practice aid may no longer be in use. However, since the practice aid is securely clamped to the shaft at a carefully preselected location, the club may be swung with the practice aid in place, i.e., the aid may be left on the shaft even in non-practice situations.

It is therefore seen that the primary object of this invention is to provide a golf training aid releasably attachable to a golf club shaft that provides a visual indication to the golfer when a particular club is being held at the proper lie angle.

A related object is to provide such a device that is light in weight so that it may remain attached to a golf club shaft when the club is swung.

Still another object is to provide an adjustable device that can be adjusted so that it can be used with all of the clubs used by golfers.

Additional objects will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
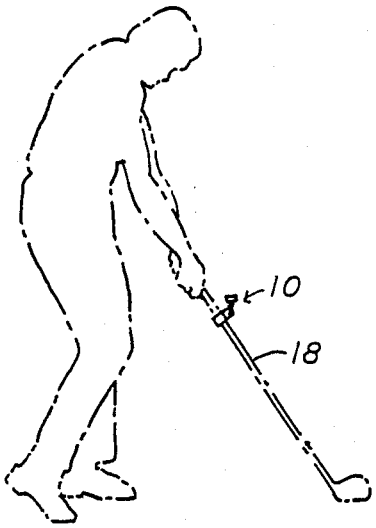
FIG. 1 is a phantom view of golfer holding a golf club equipped with the novel device.

Referring now to the drawings, it will there be seen that the first embodiment of the invention is denoted by the reference numeral 10 as a whole.

Figure 2:
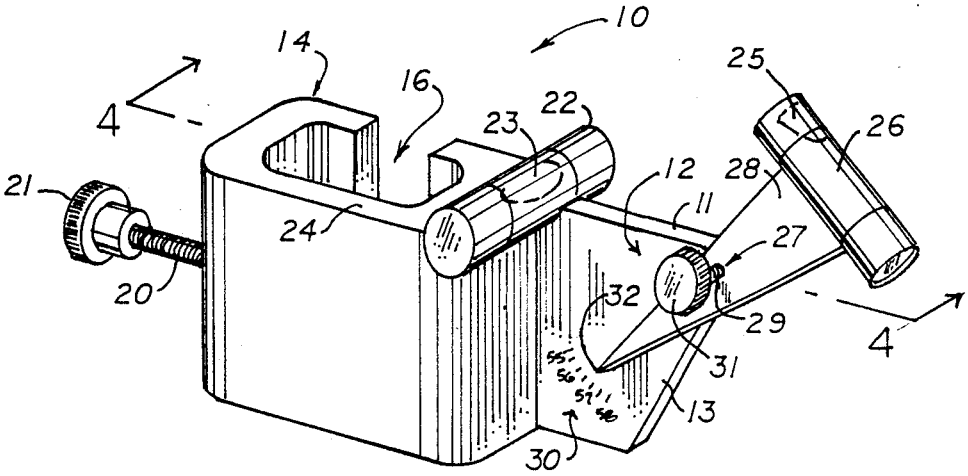
FIG. 2 is a perspective view of a first embodiment of the invention.
Figure 4:
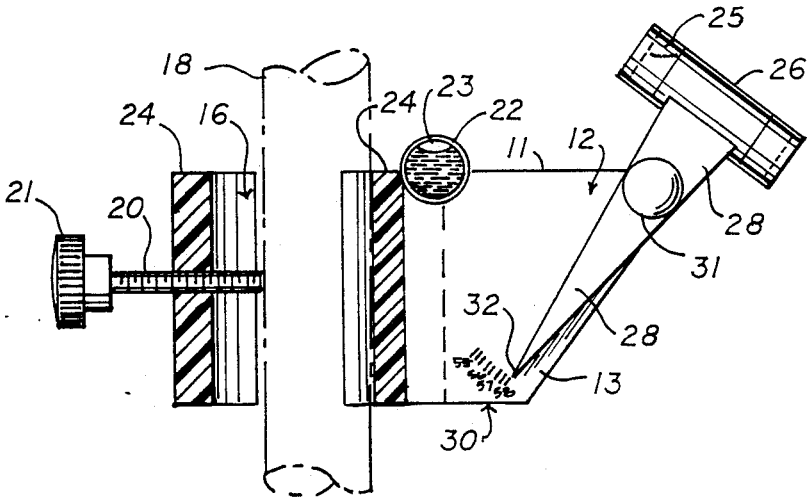
FIG. 4 is a longitudinal sectional view taken along line 4—4 in FIG. 2.

As best shown in FIG. 2, device 10 includes a flat base plate member 12 fixedly secured by suitable means to clamp member 14; cavity 16 of clamp member 14 receives a golf club shaft 18 (FIGS. 1, 4 and 5) and set screw 20 having knurled handle 21 locks device 10 in place. The device 10 is secured at the fulcrum point of the shaft 18 so that it may remain in position when the club is swung.

A transversely disposed, linear-in-configuration bubble tube 22 is mounted at the forward end of clamp 14; a semi-circular recess is formed in the top wall 24 of said clamp and top wall 11 of base plate 12 to serve as a cradle means for said member 22. When bubble 23 is centered in tubular member 22, shaft 18 is disposed in a vertical plane.

A longitudinally disposed, linear-in-configuration bubble tube 26 is fixedly secured atop an indicator means 28; said indicator means is pivotally secured to base plate member 12. The pivot point is denoted 27, generally. More specifically, base plate 12 has a transverse bore means formed in its forwardmost and uppermost corner and indicator means 28 is substantially centrally apertured; a screw member 29 having a knurled handle 31 extends through said bore means and said aperture to thereby pivotally connect said indicator means 28 to said base plate 12. A nut means, on the opposite side of base plate 12, not shown, prevents rotation of indicator means 28 relative to base plate 12 when tightened.

Rotation of indicator means 28 effects simultaneous and corresponding rotation of bubble tube 26 in a vertical plane when bubble 23 of tube 22 is centered.

A plurality of indicia members 30 are imprinted or otherwise affixed to vertical surface 13 of base plate member 12; each indicia member represents a club head lie angle.

Indicator member 28 is tapered as shown and terminates in a point 32 that registers with a preselected indicia member as illustrated.

To use device 10, the golfer selects a club and rotates indicator means 28 and hence point 32 until said point 32 is in registration with the specific indicia member for the lie angle of that club head. For example, since the lie angle of a 4 wood is fifty six and one-half degrees, the golfer sets indicator member point 32 on that lie angle. The golfer then brings the shaft 18 of the club into a vertical plane by centering bubble 23 of bubble tube 22 and rotates the shaft 18 within said vertical plane until bubble 25 of the bubble tube 26 is centered. When both bubbles are centered, the golfer is holding the club properly. The golfer may then begin a back swing, and through proper turning of the wrists, maintain both bubbles in the center of their respective tubes, at least for a small part of the back swing. By keeping both bubbles centered through repetitive practice, the golfer develops a muscular memory of how to hold the club, and the number of off target shots declines.

Figure 3:
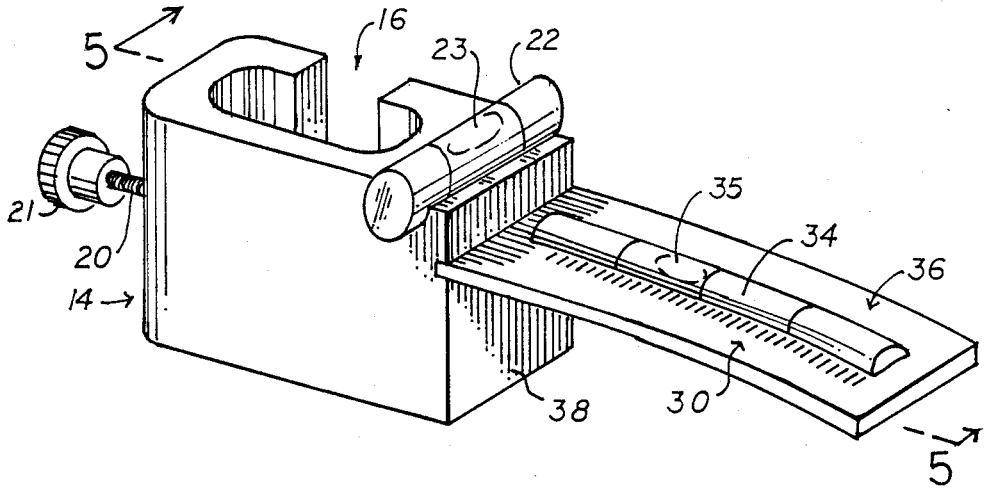
FIG. 3 is a perspective view of a second embodiment of the invention.
Figure 5:
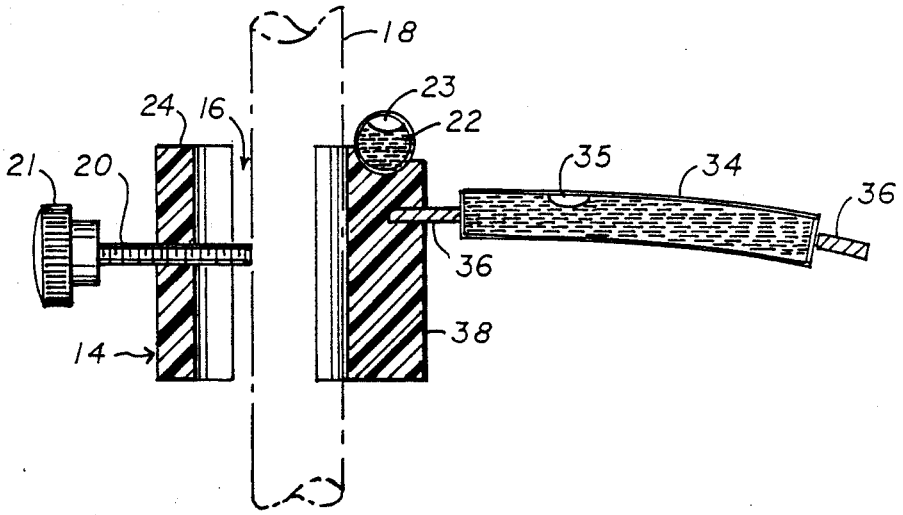
FIG. 5 is a longitudinal sectional view taken along line 5—5 in FIG. 3.

A second embodiment of the device is shown in FIGS. 3 and 5.

In this embodiment, the transversely mounted bubble tube 22 is again employed, but not the pivotally mounted bubble tube 26 or the pointed indicator means 28. However, many of the parts are the same or similar as indicated by the reference numerals in FIGS. 3 and 5.

Bubble tube 34 of this second embodiment is arcuate in configuration as shown and is not rotatably mounted. More particularly, it is mounted in a complementally-formed slot formed in arcuate plate 36. Plate 36 is fixedly secured to forward vertical wall 38 of base member 14 in the manner depicted or other suitable manner.

Indicia members 30 are imprinted or otherwise affixed to arcuate plate 36 adjacent tube 34. As in the first-described embodiment, each indicia member 30 corresponds to a specific lie angle.

In a preferred embodiment of this second embodiment, the radius of curvature of arcuate bubble tube 34 and plate 36 is about 14¼ inches. Thus, each quarter inch of bubble 35 travel represents about a one degree change in the lie angle.

To use this second embodiment, the golfer first centers the transverse bubble 23 as in the first embodiment. Next, shaft 18 is rotated in the vertical plane until bubble 35 in arcuate tube 34 aligns with the known lie angle of that club.

In a contemplated commercial embodiment of the novel device, separate devices will be sold for use with woods and irons. For woods, the lie angle change for woods is in one-half degree increments, beginning at a fifty-five degree lie angle for a 1 wood and ending at a fifty-eight degree lie angle for a 7 wood. For irons, the lie angles increase one degree for each club head, beginning at a fifty-six degree lie angle for a 1 iron and ending at a sixty-five degree lie angle for a 9 iron.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A golf practice aide, comprising:

a flat base member;

a clamp means, attached to said base member, for releasably securing said base member to a golf club shaft at a predetermined location along the extent thereof;

said base member being disposed in coplanar relation to a club head that is fixedly secured to a distal end of said shaft;

a first linear-in-configuration bubble tube member;

a rotatably mounted indicator means to which said first bubble tube member is fixedly secured so that rotation of said indicator means effects simultaneous and corresponding rotation of said first bubble tube member;

said first bubble tube member being disposed in coplanar relation to said club head;

a plurality of indicia members being provided on a preselected surface of said base member;

said indicator means being disposed in registration to said preselected surface and being movable with respect thereto;

each of said indicia members corresponding to a different lie angle of a golf club head;

whereby said indicator means is aligned with a preselected indicia member corresponding to the lie angle for the club head being held and the golfer positions the golf club shaft until a bubble in said bubble tube member is centered, said shaft being held in its correct orientation when said bubble is centered.

2. The practice aide of claim 1, further comprising:

a second linear-in-configuration bubble tube member;

said second bubble tube member being fixedly secured to said base member;

said second bubble tube member being transversely disposed relative to said club head;

whereby a golfer manipulates the club shaft until a bubble in said second bubble tube member is centered, said centering indicating that the shaft is in a vertical plane.

3. The practice aide of claim 2, further comprising:

a locking means for selectively locking said indicator means into a preselected position of rotational adjustment corresponding to a preselected lie angle.

4. The practice aid of claim 3, wherein said second bubble tube member is positioned intermediate said first bubble tube member and said golf club shaft.

5. A combination device having utility as a golfing practice aide, comprising:

a flat base member;

a clamp means, secured to said base member, for releasably securing said base member to a golf club shaft at a predetermined location along the extent thereof;

said base member being disposed in coplanar relation to a club head that is fixedly secured to a distal end of said shaft;

a first linear-in-configuration bubble tube member fixedly secured to said base member;

said first bubble tube member being transversely disposed relative to said club head;

a second linear-in-configuration bubble tube member;

a rotatably mounted indicator means to which said second bubble tube member is fixedly secured so that rotation of said indicator means effects simultaneous and corresponding rotation of said second bubble tube member;

said second bubble tube member being disposed in coplanar relation to said club head;

a plurality of indicia members being provided on a preselected surface of said base member;

said indicator means being disposed in overlying relation to said preselected surface;

each of said indicia members indicating a different lie angle of a golf club head;

whereby said indicator means is aligned with a preselected indicia member and a golfer holds the golf club shaft until said first and second bubble tube members indicate that the shaft is held in a vertical plane and that the club head is held at its proper lie angle, respectively.

6. The device of claim 5, further comprising locking means for selectively locking said mounting means into a preselected position of rotational adjustment corresponding to a preselected lie angle.

7. The device of claim 6, wherein said first bubble tube member is positioned intermediate said second bubble tube member and said golf club shaft.

8. A combination device having utility as a golfing practice aide, comprising:

an arcuate-in-configuration base member;

a clamp means, secured to said base member, for releasably securing said base member to a golf club shaft at a predetermined location along the extent thereof;

an arcuate in configuration bubble tube member fixedly secured atop said base member;

a plurality of indicia members being provided along the extent of said base member, adjacent said bubble tube member;

each of said indicia members indicating a different lie angle for a golf club head;

whereby alignment of a bubble in said bubble tube member with a preselected indicia member indicates a correct position for a golf club head when said indicia member corresponds to the lie angle for that club head.

* * * * *